United States Patent [19]

Adamoli et al.

[11] 4,308,794

[45] Jan. 5, 1982

[54] HAMMER ASSEMBLY FOR A SERIAL TYPING DEVICE

[76] Inventors: Contardo Adamoli, Str. dei Sospiri 11, 10081 Castellamonte (Turin); Remo Falconieri, Str. per Cuceglio, 10090 S. Giorgio Canavese (Turin), both of Italy

[21] Appl. No.: 55,782

[22] Filed: Jul. 9, 1979

[30] Foreign Application Priority Data

Jul. 13, 1978 [IT] Italy ..... 68657 A/78

[51] Int. Cl.[3] ..... B41J 7/92

[52] U.S. Cl. ..... 101/93.03; 101/93.48; 400/144.2; 400/157.2; 400/166

[58] Field of Search .... 101/93.02, 93.03, 93.29–93.34, 101/93.48; 400/157.2, 124, 144.2, 144.3, 166

[56] References Cited

U.S. PATENT DOCUMENTS

| | | | |
|---|---|---|---|
| 3,302,562 | 2/1967 | Nelson | 101/103 |
| 3,335,659 | 8/1967 | Schacht et al. | 101/93.02 |
| 3,900,094 | 8/1975 | Larson et al. | 400/124 |
| 3,941,052 | 3/1976 | Dalziel | 101/93.48 |
| 4,016,965 | 4/1977 | Wirth et al. | 400/124 |
| 4,070,963 | 1/1978 | Weaver | 101/93.29 |
| 4,103,617 | 8/1978 | O'Brien et al. | 101/93.03 |
| 4,137,513 | 1/1979 | Reece et al. | 400/127 |
| 4,162,858 | 7/1979 | Brandenburg | 101/93.03 X |
| 4,192,230 | 3/1980 | Blom et al. | 101/93.03 |

FOREIGN PATENT DOCUMENTS 1436992 5/1976 United Kingdom ..... 101/93.03

OTHER PUBLICATIONS

Engel et al., IBM Tech. Discl. Bulletin, vol. 15, No. 3, Aug., 1972, p. 916.

*Primary Examiner*—Edward M. Coven

*Attorney, Agent, or Firm*—Schuyler, Banner, Birch, McKie & Beckett

[57] ABSTRACT

A hammer assembly for a serial typing device which comprises a character bearing disk having a central hub and a plurality of flexible laminae radiating therefrom each carrying a particular character. The hammer assembly comprises a hammer which is actuatable for selectively causing the lamina of the selected character to strike against a sheet bearing platen for typing. The hammer is directly fixed to the armature of a plunger electromagnet which is energizable with a substantially constant current. The fixed pole pieces of the electromagnet and the armature connected to the hammer have pole surfaces inclined with respect to the longitudinal axis of the hammer, so that the impact force of the hammer varies directly as the energization time of the electromagnet while it remains substantially constant during the entire stroke of the hammer.

1 Claim, 6 Drawing Figures

HAMMER ASSEMBLY FOR A SERIAL TYPING DEVICE

BACKGROUND OF THE INVENTION

The present invention relates to a hammer assembly for a serial typing device for typewriters, text editing systems accounting machines, teleprinters and similar office machines, comprising a characters bearing element having flexible laminae which are selectively positioned in front of a platen; the hammer assembly comprises a printing hammer selectively movable for bringing a selected character towards the platen and an electromagnet which actuates the printing hammer. Typically, the character bearing element is of the "daisy" type, wherein the flexible laminae are radially mounted on a central hub, and wherein at the periphery of each lamina a particular character is mounted; the rotation of the hub brings the selected character in a printing position in front of the platen.

In devices of this type, the hammer is required to be operated in very high speed printing cycles and to have a long stroke, for effecting the typing of selected character. The long stroke is required for providing to the hammer a rest position far enough from the laminae, to permit the free rotation of the disc, and a work position thereof causing the selected lamina to flex to strike against the platen. Moreover, it is further required that the impact force of the hammer be varied in dependence either on the dimension of the selected character, or in dependence on the number of copies to be typed. The hammer accelerates during its strokes and its impact force against the platen is determined by the kinetic energy accumulated during its throw.

An assembly of the above-mentioned kind is known in which the typing hammer is actuated by an electromagnet of flat-faced armature type, wherein a short air gap is interposed between the armature and the pole pieces of the magnetic core. A lever connects the armature to the hammer for effecting the necessary long stroke of the hammer towards the printing position. The resulting assembly is cumbersome and costly. Moreover, the force applied by the armature to the hammer varies inversely with the gap length and complex and expensive electric circuits are necessary for obtaining the required variations of the intensity of the impact forces.

There are also known electromagnets having armatures of the plunger type which move through relatively long strokes and are subject to magnetic forces substantially constant during their movement. The forces induced on the armatures are thereafter directly used for actuating driven parts of machines. These electromagnets have been generally used on servomechanisms and the like, because of the simplicity in provision of the force versus displacement of these armatures and of their smoothness in operation.

SUMMARY OF THE INVENTION

One object of the present invention is to realize a hammer assembly which is simple and of small dimensions and which has a relatively long working stroke.

Another object of the invention is to provide a hammer assembly for high printing speed and high impact forces.

A further object of the invention is to provide a hammer assembly wherein the hammer is subject to acceleration forces substantially constant before the platen is struck, and directly proportional to the energy applied to the electromagnet.

According to the present invention there is provided a hammer assembly for a serial typing device comprising a platen, a flexible laminae characters bearing element and means for selectively positioning said laminae in front of said platen in a printing position, said assembly comprising a typing hammer and an electromagnet for actuating said hammer towards said platen in a direction substantially perpendicular to said platen, and wherein said electromagnet comprises a hollow core defining a gap therein, an energizable coil surrounding said hollow core, a control circuit actuatable for energizing said coil with a substantially constant current, an armature directly fixed to said hammer, and guide means for guiding said armature movably across said gap, wherein said core and said movable armature each have pole surfaces inclined with respect to the direction of movement of said armature for shortening said gap upon actuation of said control circuit to hold substantially constant the force applied by said coil to said typing hammer along its stroke towards said platen, whereby causing the impact energy applied to the hammer to be substantially directly proportional to the energization time of said coil.

BRIEF DESCRIPTION OF THE DRAWING

The invention will be described in more detail, by way of example, with reference to the accompanying drawings, in which.

DESCRIPTION OF A PREFERRED EMBODIMENT

Figure 1:
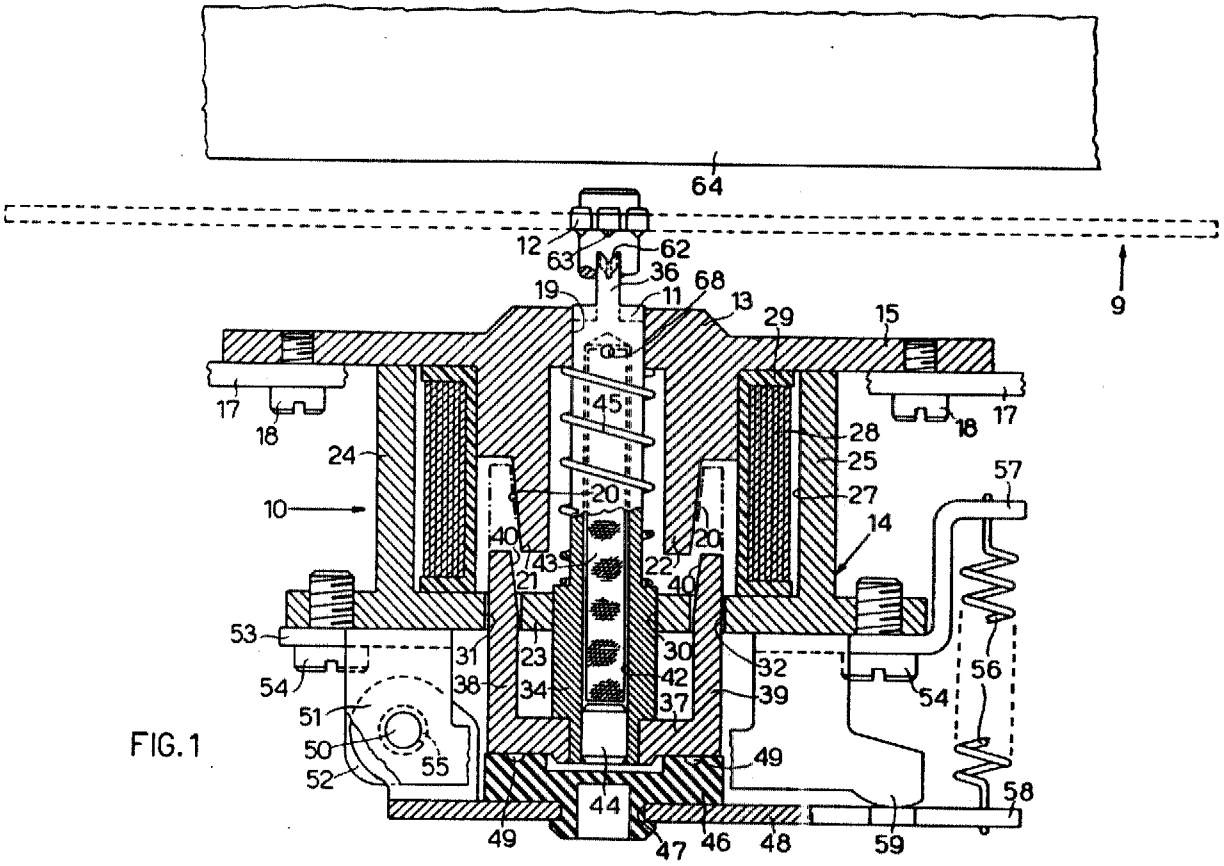
FIG. 1 is a plan view, partly in section, of the first hammer assembly embodying the invention.

The device according to the invention comprises a type bearing element 9 of the flexible lamina type (FIGS. 1 and 2) facing a platen 64, a striking hammer 11 and an electromagnet 10 suitable for axially displacing the hammer 11. The type bearing element 9 is of a known type, for instance of the type described in Italian Pat. No. 1,016,590, granted on June 20, 1977 to the Applicant, and comprises a rotatable hub 69 on which flexible laminae 70 are radially mounted. Each lamina bears on its periphery a type element 12 which, upon rotation of the hub 69, is moved into printing position in front of the platen 64.

Figure 3:
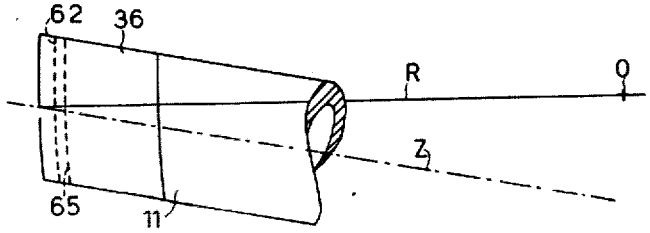
FIG. 3 is a partial view of a detail of FIG. 2 on a larger scale.

The rotational axis of the hub 69 and the Z axis of the hammer 11 (see also FIG. 3) are inclined by about 14° with respect to the horizontal plane of the machine.

The electromagnet 10 comprises a ferro-magnetic core having a fore part 13 and a rear part 14 which are joined together, for instance, by soldering. The part 14 of the core comprises a supporting plate 15 substantially rectangular in shape, which is suitable for being fixed, for example by screws 18, to a fixed element 17 of the machine. The part 14 of the core further comprises a central through-hole 19 in which the rear part of the hammer 11 may slide, and two magnetic cores 21 and 22, each of which presents a polar surface inclined and convergent towards the rear part of the hammer 11. The part 13 of the core comprises a substantially rectangularly shaped plate and two rear, mutually parallel extensions 24 and 25 defining a substantially parallelepiped shaped opening in which an excitation solenoid 28 is housed, having coils wound on a structure of plastic material. The plate 23 has a through-hole 30 in which the fore part of the hammer 30 slides, and two openings 31 and 32, substantially rectangular in shape and mutually parallel. The hammer 11 has a cylindrical stem 34 made of non-magnetic material, such as stainless steel for example, having a rear head 36 which will be described in detail later herein. The stem 34 is fixed in its fore part to an element 37 of ferro-magnetic material, suitably shaped in order to have two magnetic cores 38 and 39 slideable with play between the openings 31 and 32. Each core 38 and 39 has an inclined polar surface 40, suitable for coupling with the corresponding surfaces 20 of the magnetic cores 21 and 22 due to the effect of magnetic flux generated by the solenoid 28. The inclination of the polar surfaces 20 with respect to the Z axis of the hammer 11 is in the range 5°-15°. In the described embodiment a value of 7° for the inclination has been chosen.

Figure 4:
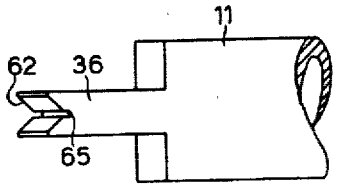
FIG. 4 is a bottom view of the detail of FIG. 3.

The hammer 11 has within it a cylindrical cavity 42, in which a felt piece 43, impregnated with lubricating oil, is housed. The cavity 42 is sealed at its fore end by an airtight stopper 44. In correspondence with the rear and fore guiding holes 19 and 30, the stem 34 is provided with two radial holes 68 and 69 respectively out of which seeps the lubricating oil contained in the cavity 42. A helicoidal spring 45 is wound around the stem 34, holding the hammer 11 normally away from the type bearing element 12. In the rest position, the group constituted by the hammer 11 and the element 37 leans against a rubber block 46, which is shaped so as to have front grooves 49 and is clamped in a hole 47 of a lever 48. This lever 48 is fulcrumed on a pivot 50, borne by the arms 51 and 52 of a support 53, fixed to the plate 23 by screws 54. A helicoidal spring 56 is stretched between a tongue 57 of the support 53 and an end 58 of the lever 48, keeping the lever 48 leaning against a stop 59 of the support 53. A helicoidal spring 55 wound around the pivot 50 acts as a friction element between the lever 48 and the arms 51 and 52. The head 36 of the hammer 11 (FIGS. 3 and 4) is shaped so as to have a notch 62 with a V-shaped section which is suitable for engaging with a corresponding positioning wedge 63 of each lamina 70, and for striking the selected character against the platen 64. The notch 62 has an internal groove 65 in correspondence with the vertex of the V which is obtained by rotating the V-shaped section around a horizontal axis O which is at a distance R from the edges of the V. With respect to a vertical plane passing through the vertex of the V (FIG. 3), the horizontal plane upon which the axis O lies intersects the Z axis of the hammer 11 in the middle zone of the notch 62.

The electromagnet 10 is covered by a plastic cover 66 having a rear opening 67 through which the head 36 of the hammer passes.

Figure 6:
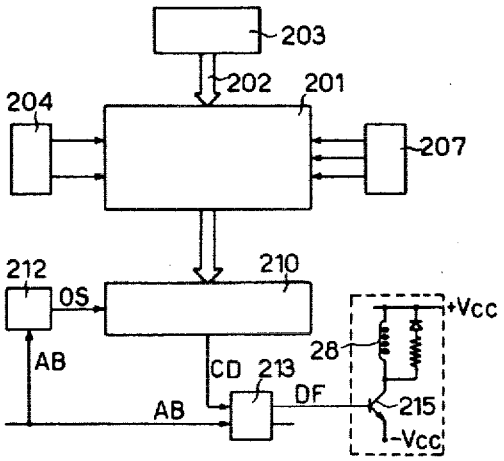
FIG. 6 is a block diagram relating to the control of the assembly of FIG. 1.

The electromagnet 10 is energized by substantially direct current, and the force applied to the hammer is proportional to the energization time t of the solenoid 28. A control circuit 200 (FIG. 6) varies such time t as a function of the character to be typed, of the typing intensity selected and of the overall characteristics of the striking device.

The characters, depending upon their dimensions, are subdivided into four groups, for example; in particular, small characters such as the period and the comma belong to the first group; the lowercase vowels belong to the second group; the taller lower-case letters belong to the third group, and the capital letters and numbers belong to the fourth group. The group to which each character belongs is stored in a ROM 201 through a channel 202 from an input device 203, which may be, for example, an electronic keyboard. Depending upon the group to which the character to be typed belongs, the time t is increased or decreased by 400 μsec with respect to a base time, as will be hereinafter described.

Moreover, in order to type on one or more copies, the typing intensity can be selected manually by moving the selector 204 to one of four positions in a known manner not described in detail here. The selector 204 is also connected to the ROM 201 and, depending on the position selected, the time t is further increased or decreased by 100 μsec, except when the selector is in the fourth position. In this position, in fact, if the character to be typed belongs to the first or second group, the time t is equal to that obtained with the selector 204 in the third position; if the character instead belongs to the third group, the time t is increased by 500 μsec with respect to that obtained with the selector in its third position; and finally, if the character belongs to the fourth group, the time t is increased by 300 μsec with respect to that obtained in analagous conditions with the selector 204 in the third position. A second selector 207 is connected to the ROM 201 for regulating the typing intensity during manufacture or maintenance service. The selector 207 has eight positions and allows the correction of possible defects in manufacture or in performance of the striking device. Depending upon the position of the selector 207, the time t is increased or decreased by 200 μsec.

The control circuit 200 further comprises a binary counter 210 with a capacity of 64, which is suitable for counting the signals OS generated by an oscillator 212, in order to generate a signal CD at the end of each count. The period of the signals OS is 100 μsec. At the start of each count, the counter 210 is presettable by the ROM 201 to a number comprised between six and thirtyseven, so as to vary the time lapse between the start and end of the count from 2.7 msec to 5.8 msec. The signal CD is suitable for resetting a flip-flop 213 of the set-reset type, which has the set input connected to a signal AB enabling printing. This signal AB is also connected to the oscillator 212. The output signal DF from the flip-flop 213 is transmitted to the base of a transistor 215 of the n-p-n type which has its emitter connected to a reference voltage −Vcc, and its collector connected to a terminal of the solenoid 28 of the electromagnet 10; the other terminal of the solenoid 28 is connected to the reference voltage +Vcc.

The operation of the striking device described so far is the following.

During the testing phase of the printer, the selector 207 is positioned on one of its eight positions, for instance on the fourth position, in order to take account of the physical and efficiency characteristics of the striking device.

In the rest position with the solenoid 28 not energized, the hammer 11 is held away from the type-bearing element 9, due to the action of the spring 45. In this position the movable magnetic cores 38 and 39 are spaced from the fixed magnetic cores 21 and 22.

Figure 2:
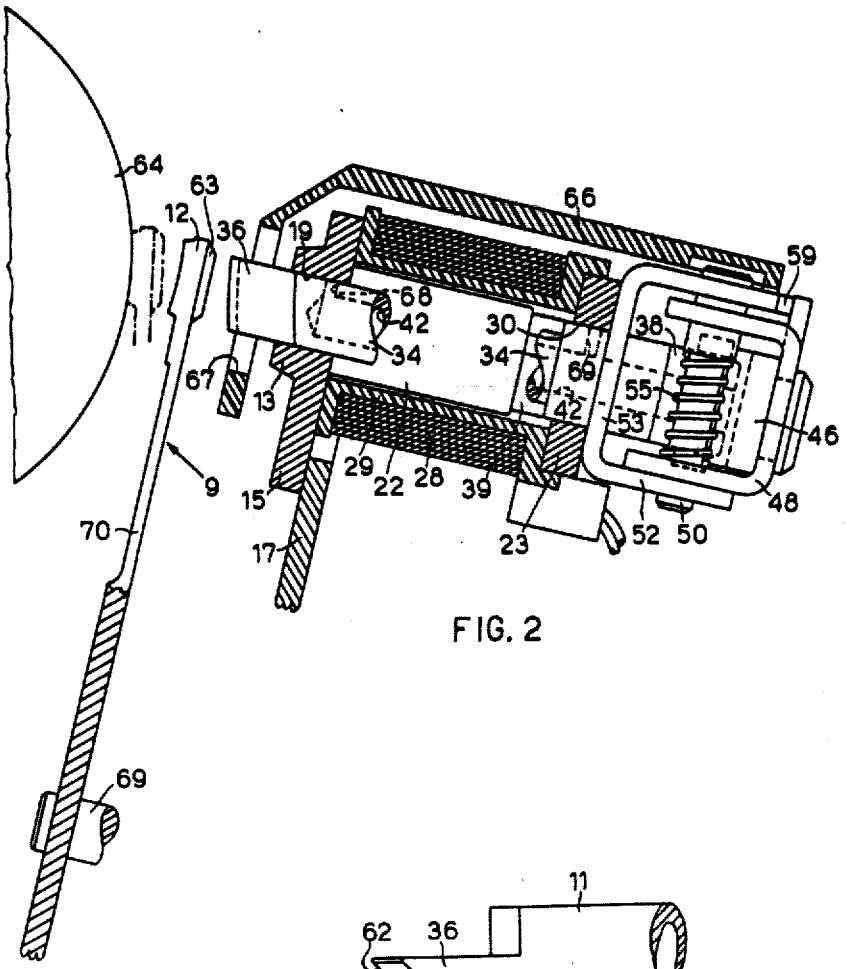
FIG. 2 is a left lateral view partly in section of the hammer assembly of FIG. 1.

In order to type a character 12 of the element 9 by striking it against the platen 64, after having in any known manner positioned the selected character in front of the hammer 11, the solenoid 28 is energized, thus producing a magnetic flux which causes the displacement of the magnetic cores 38 and 39 towards the fixed cores 21 and 22, against the action of the spring 45 (position represented by the dotted line in FIG. 1).

In this way, also the hammer 11 is displaced towards the platen 64, and after having engaged its notch 62 with the wedge 63 of the selected element 9, it strikes the corresponding character against the platen 64. The particular shape of the head of the hammer ensures a gradual engagement between the notch 62 and the wedge 63, and that at the time of impact against the platen, the character is pushed by the hammer substantially in its middle zone. In this way moreover, possible misalignments of the character with respect to the vertical axis are automatically corrected by the notch 62.

As already mentioned, the energization time of the solenoid 28 is variable as a function of the selected character and of the selected typing intensity.

Assume that the letter to be printed is M and that the selector 204 has been manually positioned in its second position, in order to have a typing intensity sufficient to type on two copies.

The group to which the letter M belongs, together with the output codes of the selectors 204 and 207 causes the ROM 201 to generate a code setting the counter 210 to eighteen. When the element 9 moves the letter M to the print position, the signal AB is generated which enables the flip-flop 213 to generate the signal DF, and the oscillator 212 to generate the signal OS. The signal DF commands the effective excitation of the solenoid 28.

In the example being considered, after a time of 4.6 msec, corresponding to 46 signals OS, the counter 210 generates the end of count signal CD and the flip-flop is reset and the excitation of the solenoid 28 ceases. The time of 4.6 msec is in fact equal to the base time which is 2.7 msec, plus 600 μsec due to the fourth position of the selector 207, plus 1200 μsec due to the character belonging to the fourth group, plus 100 μsec due to the selector 204 being in the second position. After the termination of excitation of the solenoid 28, and the hammer 11, by inertia, has struck the selected character, the spring 45 returns the group constituted by the hammer 11 and the element 37 to its rest position. The rubber 46, the spring 56 and the friction spring 55 dampen the impact due to the rapid return of this group, without making it oscillate. In this way, a new typing cycle can be effected by again exciting the solenoid 28.

The presence of the felt 43 impregnated with oil inside the hammer 11, ensures a constant lubrication between the guiding holes 19 and 30 and the hammer itself.

Figure 5:
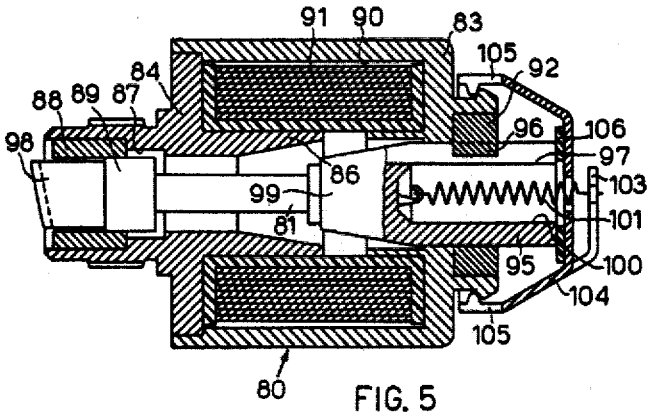
FIG. 5 is a plan view, partly in section, of a second hammer assembly embodying the invention.

According to another embodiment of the present invention, shown in FIG. 5, the striking device comprises an electromagnet 80 and a striking hammer 11 different from those described above. The electromagnet 80 comprises a ferromagnetic core constituted by a fore part 83 and a rear part 84 fixed together by soldering, for instance.

The rear part 84 is shaped so as to have a frustroconical magnetic core and a cylindrical cavity 87, in which a bushing 88 is situated guiding the rear part 89 of the hammer 81. The part 84 is provided with a thread 85 by means of which the striking device may be fixed to the printer upon which it is to be mounted. The fore part 83 (on the right in FIG. 5) defines a cavity 90 in which an excitation solenoid 91 is housed, and which supports a bushing 92 which guides the fore part 95 of the hammer. The bushing 92 has an interior tooth 96 lodged in a groove 97 of the hammer 81 to prevent the rotation of the latter.

The fore part 95 of the hammer 81 is made of ferromagnetic material and has a frustroconical magnetic core 99 suitable for coupling with a corresponding magnetic core 86. In this case the inclination of the polar surfaces of the magnetic cores 86 and 99 with respect to the axis of the hammer 81 is about 10°. Inside the part 95 is a cylindrical cavity 100, in which a spring 101 is hooked, having its other end hooked to an arm 103 of a cover 104. This cover 104 is hooked to the part 83 of the core by resilient tongues 105 and supports a dampening plastic block 106, against which the hammer 81 is held by the spring 101. The hammer 81 is shaped so as to have a cylindrical non-magnetic stem which joins together the parts 89 and 95, and a head 98 substantially equal to that of the hammer 11.

The operation of this second striking device is similar to that previously described, even if the excitation times of the solenoid 91 are shorter than those of the solenoid 28, since this second device has smaller masses in motion and has a higher electrical efficiency, due to the increased flux between the fixed and movable magnetic cores 86 and 99.

It is obvious that additions of parts or modifications to the striking devices so far described may be made without departing from the spirit of the present invention as hereinafter claimed.

What we claim is:

1. A hammer assembly for a serial typing device comprising a platen, a characters-bearing element having a plurality of characters carried by a corresponding plurality of flexible laminae and means for selectively positioning said laminae in front of said platen in a printing position; said hammer assembly comprising a typing hammer, an electromagnet for actuating said typing hammer in a direction substantially perpendicular to said platen to flex the selected lamina and to strike the corresponding character against said platen, said electromagnet comprising a fixed core, a movable armature directly fixed to said hammer and an energizable coil surrounding said fixed core, means for varying the impact energy of said hammer only by varying the duration of energization of said coil, said means comprising a pole surface of said fixed core inclined with respect to the direction of movement of said hammer, and pole surfaces of said movable armature parallel to the inclined pole surface of said fixed core and a control circuit which energizes said coil with a current of a substantially constant amplitude and a length of time substantially directly proportional to the impact energy to be applied to said hammer, guide means in said fixed core for guiding said hammer, a cavity provided in said hammer, a felt impregnated with lubricating oil contained in said cavity and a hole provided in said hammer and communicative with said guide means for lubricating said guide means.

* * * * *